United States Patent [19]

Jakobsen

[11] Patent Number: 4,928,819

[45] Date of Patent: May 29, 1990

[54] AIR PERMEABLE CAMERA CASE

[75] Inventor: Katherine Jakobsen, Aurora, Colo.

[73] Assignee: Satter, Inc., Denver, Colo.

[21] Appl. No.: 407,262

[22] Filed: Sep. 14, 1989

[51] Int. Cl.[5] ..... A45C 11/38; B31B 1/72

[52] U.S. Cl. ..... 206/316.2; 224/908; 354/288; 493/84; 493/114

[58] Field of Search ..... 206/316.2, 316.1; 224/908; 354/75, 76, 288; 493/84, 114, 210, 220

[56] References Cited

U.S. PATENT DOCUMENTS

| | | | |
|---|---|---|---|
| 1,042,963 | 10/1912 | Peterson | 206/316.2 |
| 1,088,885 | 3/1914 | Dorris | 206/316.2 |
| 1,090,079 | 3/1914 | Livingston | 206/316.2 X |
| 1,220,957 | 3/1917 | Conway | 206/316.2 X |
| 1,505,884 | 8/1924 | Goldquist | 206/316.2 |
| 1,513,176 | 10/1924 | Lyde | 206/316.2 |
| 1,535,312 | 4/1925 | Hosking . | |
| 1,925,694 | 9/1933 | Hawkins | 206/316.2 |
| 2,223,219 | 11/1940 | Mayerovitz . | |
| 2,387,392 | 10/1945 | Guyer et al. | 493/114 X |
| 2,482,248 | 9/1949 | Coon . | |
| 3,465,652 | 9/1969 | Bell et al. | 493/114 |
| 3,473,590 | 10/1969 | Rohlik . | |
| 3,536,040 | 10/1970 | Pickett . | |
| 3,587,699 | 6/1971 | Kovach . | |
| 3,793,528 | 2/1974 | Takeda . | |
| 3,813,017 | 5/1974 | Pimsleur | 224/908 X |
| 4,000,769 | 1/1977 | Katz | 206/316.2 |

FOREIGN PATENT DOCUMENTS

| | | | |
|---|---|---|---|
| 0977184 | 3/1951 | France | 206/316.2 |
| 0227311 | 1/1925 | United Kingdom | 206/316.2 |
| 0295332 | 7/1929 | United Kingdom | 354/288 |

*Primary Examiner*—Bryon P. Gehman
*Attorney, Agent, or Firm*—Duane Burton

[57] ABSTRACT

Disclosed is a camera case having an air permeable, resilient body and air permeable resilient end plates. A novel method of assembling the case is also disclosed. The body of the case has first and second end edge portions and first and second side edge portions. The body also defines a front, bottom and rear walls and a closing flap of the case. Each end plate has a front edge portion, a bottom edge portion, a rear edge portion, a top edge portion and a notched edge portion. The notched edge portion is sized and configured to mate with the first end edge portion of the body so that outer surface of the front wall and the top edge portions of each end plate will be flush with each other when they are joined together. The case is assembled by applying adhesive to the notched edge portions, the front edge portions, the bottom edge portions and the rear edge portions of the end plates. The first end edge of the body is then located up against the adhesive coated notched portions of each end plate and aligned therewith so that the top edge portions of the end plates are flush with the outer surface of the front wall. The body is then wrapped about the end plates and aligned therewith so that the outer surfaces of the end plates are flush with the respective side edges of the body. The body is maintained in the wrapped position until the body bonds to the end plates.

12 Claims, 1 Drawing Sheet

AIR PERMEABLE CAMERA CASE

TECHNICAL FIELD

The invention relates generally to cases for storing electronic equipment and, more particularly, to an improved camera case.

BACKGROUND ART

The prior art is replete with many types of camera cases. For example, U.S. Pat. No. 3,473,590 to Rohlik discloses a camera case having a central body of flexible material and molded end plates. The edges of the central body project into channels provided in the molded end plates to secure the end plates to the body. Adhesive is also provided to bond the edges of the body to the channels of the end plates. This camera case was apparently the first camera case to be manufactured without any stitching, i.e., no stitching is employed to secure the end plates to the body portion of the camera case.

Other patents disclosing camera cases and other types of cases which were found in a search of the prior art relating to camera cases include U.S. Pat. No. 1,535,312 to Hosking; U.S. Pat. No. 2,223,219 to Mayerovitz; U.S. Pat. No. 2,482,248 to Coon; U.S. Pat. No. 3,536,040 to Pickett; U.S. Pat. No. 3,587,699 to Kovach; and U.S. Pat. No. 3,793,528 to Takeda.

While the cases disclosed in the aforementioned patents undoubtedly work as intended, none of them nor any other known to the present inventor are specifically designed to minimize or prevent heat damage to photographic film which is loaded in a camera that is stored in the case. Photographic film often gets damaged when, for example, the camera containing the film is exposed to the direct rays of the sun. Such could occur, for example, when the camera is left on the seat of a car. Of course, the problem would be aggravated if the car's windows were closed.

Some camera cases, such as a loose fitting camera case, might slightly delay the overheating problem by shielding the camera from the direct rays of the sun. However, most camera cases, particularly black, tight fitting cases, aggravate the problem since the black color of the case absorbs sunlight heat, which is then conducted by the tight fitting case directly to the camera. As such, the case and camera act like an oven almost cooking, if you will, the film loaded in the camera.

Accordingly, it would be desirable if a camera case were available that would not only shield a camera from the direct rays of the sun but also minimize or at least delay the build up of heat inside the case. It would also be desirable if such a camera case were capable of being easily manufactured. It would further be desirable if such a camera case had shock absorbing capabilities that would minimize damage to the camera if it were dropped.

DISCLOSURE OF THE INVENTION

The present invention addresses the aforementioned needs by providing a camera case having an air permeable, resilient body and air permeable, resilient end plates. The body has inner and outer surfaces which are connected by a peripheral edge. The body's peripheral edge has a first end edge portion, a second end edge portion and first and second side edge portions. When the body is fully assembled, i.e., attached to the end plates, the body also defines a front wall, a bottom wall, a rear wall and a closing flap of the case.

Each end plate has inner and outer surfaces which are also connected by a peripheral edge. The end plate's peripheral edges each have a front edge portion, a bottom edge portion, a rear edge portion, a top edge portion and a notched edge portion. The notched edge portion connects the top edge portion to the front edge portion. The notched edge portion is also sized and configured to mate with the first end edge portion of the body so that the outer surface of the front wall and the top edge portions of each end plate will be flush with each other when they are joined or bonded together.

When the case is assembled, each notched edge portion of the end plates is bonded to the first end edge of the body so that the top edge portions of each end plate are flush with the outer surface of the front wall. The front, bottom and rear edge portions of the end plates are also bonded to the inner surfaces of the front, bottom and rear walls of the body, respectively. The end plates are also aligned or positioned with the body so that the outer surface of the first end plate is flush with the first side edge of the body and so that the second end plate is flush with the second side edge of the body. The end plates are bonded to the body with an adhesive, preferably a solvent based (toluene or naphtha) rubber cement or a hot-melt adhesive.

The camera case also preferably includes fastening means for fastening the front flap to the front wall of the case. In addition, the camera case also preferably includes a carrying strap which is attached to the end plates of the case.

The present invention also provides a novel method for assembling the camera case which includes providing an air permeable, resilient body having inner and outer surfaces which are connected by a peripheral edge. The peripheral edge has a first end edge portion, a second end edge portion, a first side edge portion and a second side edge portion. In addition, the body also defines a front wall, a bottom wall, a rear wall and a closing flap of the case.

The method also includes providing first and second air permeable, resilient end plates, each of which has inner and outer surfaces which are connected by a peripheral edge. The peripheral edge of each end plate has a front edge portion, a bottom edge portion, a rear edge portion, a top edge portion and a notched edge portion. The notched edge portion connects the top edge portion to the front edge portion. In addition, the notched edge portion is sized and configured to mate with the first end edge portion of the body so that the outer surfaces of the front wall of the body and the top edge portions of each end plate will be flush with each other when they are joined or bonded together.

The method also includes applying adhesive to the notched edge portions, the front edge portions, the bottom edge portions and the rear edge portions of the end plates. After applying the adhesive, the case is assembled by locating the first end edge of the body up against the adhesive coated notched portions of each end plate so that the top edge portions of the end plates are flush with the outer surface of the front wall and so that the outer surface of the first end plate is flush with the first side edge of the body and so that the outer surface of the second end plate is flush with the second side plate of the body. The body is then wrapped about the peripheral edges of the end plates so that the outer surface of the first end plate is flush with the first side edge of the body and the outer surface of the second end plate is flush with the second side plate of the body. The body is then maintained in the wrapped position about the peripheral edges of the end plate until the front, bottom and rear walls of the body bond, respectively, to the front, bottom and rear edge portions of the end plates. The closing flap does not bond to the top edge portions of the end plate because the top edge portions are not coated with the adhesive.

BRIEF DESCRIPTION OF THE DRAWINGS

The invention will be more readily understood by reference to the accompanying drawings wherein like reference numerals indicate like elements throughout the drawing figures and in which.

BEST MODE FOR CARRYING OUT THE INVENTION

Figure 1:
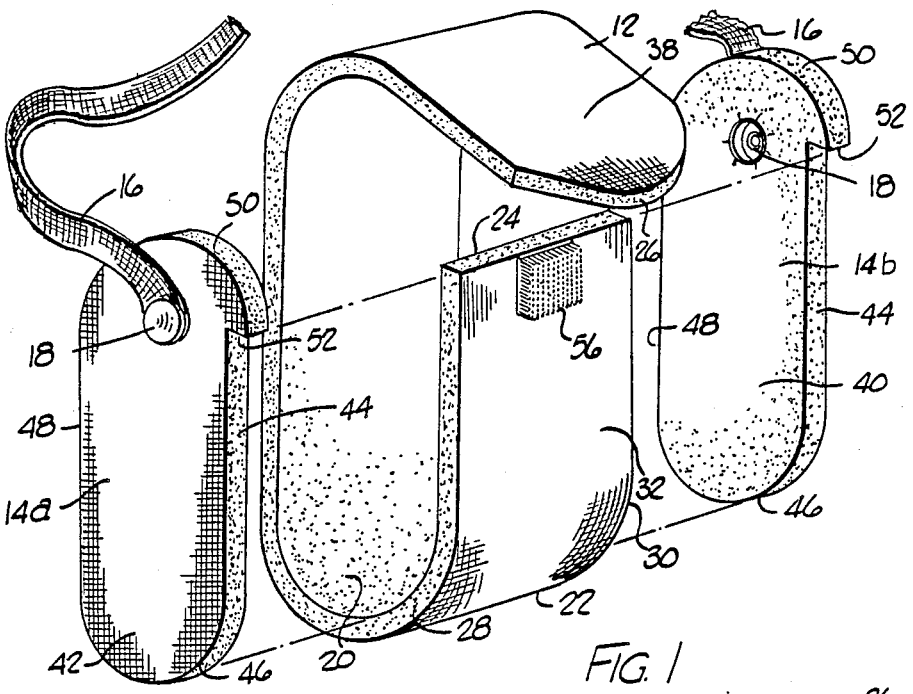
FIG. 1 is an exploded perspective view of a camera case of the present invention.
Figure 2:
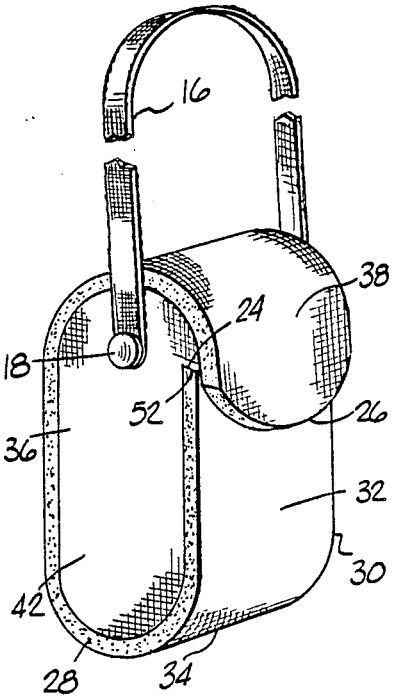
FIG. 2 is a perspective view of the camera case of FIG. 1.

FIGS. 1 and 2 illustrate a camera case 10 of the present invention. As best illustrated in the exploded view of FIG. 1, case 10 generally includes a body 12 and a pair of end plates 14*a* and *b*. End plates 14*a* and *b* are secured to body 12 by an adhesive, the application of which will be described in more detail below.

Body 12 and end plates 14 are made from air permeable and resilient material such as neoprene. Neoprene is particularly preferred because it is also waterproof. Case 10 also includes a carrying strap 16, preferably an adjustable strap, which is attached at its respective ends to end plates 14*a* and *b* by conventional grommet-like fastening means 18.

Figure 4:
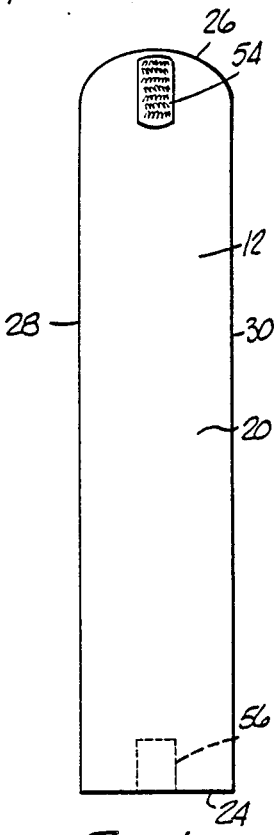
FIG. 4 is a side elevational view of the body of the camera case of FIG. 1.

FIGS. 1, 2 and 4 illustrate that body 12 has a generally rectangular shape in cross section. As such, the body has parallel inner and outer surfaces 20 and 22, respectively, which are connected by a peripheral edge (not numbered). The peripheral edge has a first end edge portion 24, an arcuate second end edge portion 26, a first side edge portion 28 and a second side edge portion 30. As with surfaces 20 and 22, side edges 28 and 30 are also generally parallel to each other. When case 10 is fully assembled as illustrated in FIG. 2, body 12 also defines a front wall 32, a round or arcuate bottom wall 34, a rear wall 36 and an arcuate closing flap 38 of the case.

Figure 3:
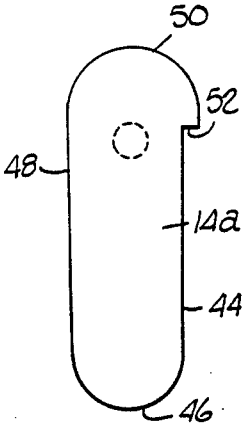
FIG. 3 is a side elevational view of an end plate of the camera case of FIG. 1.

FIGS. 1, 2 and 3 illustrate that each end plate 14*a* and *b* also has a generally rectangular shape in cross section. As such, each end plate has parallel inner and outer surfaces 40 and 42, respectively, which are connected by a peripheral edge (not numbered). The peripheral edge of each end plate has a front edge portion 44, an arcuate bottom edge portion 46, a rear edge portion 48, an arcuate top edge portion 50 and a notched edge portion 52. Notched edge portion 52 connects top edge portion 50 to front edge portion 44. Notched edge portion 52 is also sized and configured to mate or matingly engage with first end edge 24 of the body so that the outer surfaces of front wall 32 and top edge portions 50 will be flush with one another when they are joined or bonded to each other as will be described below. While as illustrated, notched edge portion 52 is generally flat, it could have almost any shape as long as first end edge portion 24 of the body is shaped to complement or mate with it, i.e., so that edge 24 and edge portion 52 are capable of matingly engaging each other.

As best visualized from FIGS. 1 and 4, case 10 also includes fastening means (not numbered) for fastening front flap 38 to front wall 32 of the case. The fastening means includes a first hook and loop type fastening portion 54 and a second hook and loop type fastening portion 56. First hook and loop type fastening portion 54 is secured to the inner surface of body 12 at a location adjacent second end edge 26, as such is best illustrated in FIG. 4. Second hook and loop type fastener 56 is secured to the outer surface of the body at a location adjacent first end edge 24 of the body, as such is best illustrated in FIG. 1. The hook and loop type fasteners are also located or aligned with respect to each other so that they are capable of engaging each other to fasten front flap 38 to front wall 32 of the case. Hook and loop type fasteners are also referred to as Velcro fasteners.

To assemble case 10, adhesive, preferably a solvent based (toluene or naphtha) rubber cement or hot-melt adhesive, is applied to notched edge portions 52, front edge portions 44, bottom edge portions 46 and rear edge portions 44 of the end plates. Body 12 is then attached to the end plates by first locating first end edge 24 of the body up against the now adhesive coated notched portions 52 of each end plate. The end plates are aligned with the body so that top edge portions 52 of the end plates are flush with the outer surface of front wall 32. The body and end plates are also aligned so that the outer surface of first end plate 14*a* is flush with first side edge 28 of the body and so that the outer surface of second end plate 14*b* is flush with second side edge 30 of the body. The remainder of body 12 is then wrapped about the peripheral edges of the end plates and aligned therewith so that the outer surface of the first end plate 14*a* is flush with side edge 28 of the body and so that the outer surface of second end plate 14*b* is flush with second side edge 30 of the body. The body is then maintained in the wrapped position until the front, bottom and rear walls of the body bond, respectively, to the front, bottom and rear edge portions of the end plates. Closing flap 38 will not bond to top edge portion 50 since top edge portion 50 is not coated with the adhesive.

To install a camera in case 10, one simply opens closing flap 38 and inserts the camera into the interior of the case. The case is then closed by simply closing flap 38 so that fastening portions 54 and 56 engage one another, thereby securing flap 38 to the front wall of the case. The case with camera stored therein, if exposed to direct sunlight, will delay overheating of the camera, thereby substantially minimizing the possibility of heat damage to the film.

Although the present invention has been described with a certain degree of particularity, it is understood that the present disclosure has been made by way of example and that changes in details of structure may be made without departing from the spirit thereof.

I claim:

1. A camera case comprising:

an air permeable, resilient body having inner and outer surfaces which are connected by a first peripheral edge, said first peripheral edge having a first end edge portion, a second end edge portion, a first side edge portion and a second side edge portion, said body also defining a front wall, a bottom wall, a rear wall and a closing flap of said case; and first and second air permeable, resilient end plates, each of which has inner and outer surfaces which are connected by a second peripheral edge, said second peripheral edge of each end plate having a front edge portion, a bottom edge portion, a rear edge portion, a top edge portion and a notched edge portion, said notched edge portion adjoining said top edge portion and said front edge portion, said notched edge portion also being sized and configured to mate with said first end edge of said body so that said outer surface of said front wall of said body is capable of being flush with said top edge portion of each end plate, said body and said end plates being secured to each other such that said first end edge of said body is bonded to said notched edge portion of said end plates and so that said inner surfaces of said front, said bottom and said rear walls of said body are bonded, respectively, to said front, said bottom and rear edge portions of said end plates, said end plates further being aligned with respect to said body so that said outer surface of said first end plate is flush with said first side edge of said body and said outer surface of said second end plate is flush with said second side edge of said body.

2. A camera case as claimed in claim 1 further comprising fastening means for fastening said front flap to said front wall.

3. A camera case as claimed in claim 2 wherein said fastening means includes a first hook and loop type fastening portion and a second hook and loop type fastening portion, said first hook and loop type fastening portion being secured to said inner surface of said body at a location adjacent said second end edge of said body, said second hook and loop type fastening portion being secured to said outer surface of said body at a location adjacent said first end edge of said body, said first and second hook and loop type fastening portions also being located so that they are capable of engaging each other to fasten said front flap to said front wall.

4. A camera case as claimed in claim 1 further comprising a carrying strap having a first end and a second end, said first end of said carrying strap being attached to said first end plate at a location adjacent said top edge portion of said first end plate, said second end of said carrying strap being attached to said second end plate at a location adjacent said top edge portion of said second end plate.

5. A camera case as claimed in claim 1 wherein said notched edge portion is generally flat.

6. A camera case as claimed in claim 1 wherein said body and said end plates are made from neoprene.

7. A camera case as claimed in claim 1 wherein said body and said end plates are bonded to each other with an adhesive.

8. A camera case as claimed in claim 7 wherein said adhesive includes solvent based rubber cements or hot-melt adhesives.

9. A camera case comprising:

an air permeable, resilient body having inner and outer surfaces which are connected by a first peripheral edge, said first peripheral edge having a first end edge portion, a second end edge portion, a first side edge portion and a second side edge portion, said body also defining a front wall, a bottom wall, a rear wall and a closing flap of said case;

first and second air permeable, resilient end plates, each of which has inner and outer surfaces which are connected by a second peripheral edge, said second peripheral edge of each end plate having a front edge portion, a bottom edge portion, a rear edge portion, a top edge portion and a notched edge portion, said notched edge portion connecting said top edge portion to said front edge portion, said notched edge portion also being sized and configured to mate with said first end edge of said body so that said outer surface of said front wall of said body is capable of being flush with said top edge portion of each end plate; and adhesive means for securing said end plates to said body, said adhesive means being located so that said first end edge of said body is bonded to said notched edge portion of said end plates and so that said front, said bottom and said rear walls of said body are bonded, respectively, to said front, said bottom and rear edge portions of said end plates, said end plates further being aligned with respect to said body so that said outer surface of said first end plate is flush with said first side edge of said body and said outer surface of said second end plate is flush with said second side edge of said body.

10. A method of assembling a camera case comprising:

providing an air permeable, resilient body having inner and outer surfaces which are connected by a first peripheral edge, the first peripheral edge having a first end edge portion, a second end edge portion, a first side edge portion and a second side edge portion, the body also defining a front wall, a bottom wall, a rear wall and a closing flap of the case;

providing first and second air permeable, resilient end plates, each of which has inner and outer surfaces which are connected by a second peripheral edge, the second peripheral edge of each end plate having a front edge portion, a bottom edge portion, a rear edge portion, a top edge portion and a notched edge portion, the notched edge portion connecting the top edge portion to the front edge portion, the notched edge portion also being sized and configured to mate with the first end edge portion of the body so that the outer surfaces of the front wall of the body and the top edge portions of each end plate are capable of being flush with each other when they are bonded to each other;

applying adhesive to the notched edge portions, the front edge portions, the bottom edge portions and the rear edge portions of the end plates;

locating the first end edge of the body up against the adhesive coated notched portion of each end plate so that the top edge portions of the end plates are flush with the outer surface of the front wall of the body and so that the outer surface of the first end plate is flush with the first side edge of the body and the outer surface of the second end plate is flush with the second side edge of the body;

after so locating the first end edge of the body, wrapping the body about the second peripheral edges of the end plates so that the outer surface of the first end plate is flush with the first side edge of the body and the outer surface of the second end plate is flush with the second side edge of the body; and maintaining the body in the wrapped position about the end plates until the front, bottom and rear walls of the body bond, respectively, to the front, bottom and rear edge portions of the end plates.

11. A method as claimed in claim 10 further comprising:

attaching fastening means to the camera case for fastening the front flap of the case to the front wall of the case.

12. A method as claimed in claim 10 further comprising:

attaching a carrying strap to the end plates of the case.

* * * * *